US007125613B1

(12) United States Patent
Tullis et al.

(10) Patent No.: US 7,125,613 B1
(45) Date of Patent: Oct. 24, 2006

(54) COATED METAL ARTICLE AND METHOD OF MAKING SAME

(75) Inventors: Bryan Tullis, Chicago, IL (US); Rebecca A. Jones, Arlington Heights, IL (US); Kevin R. Sanchez, Downers Grove, IL (US); James E. Blanton, Gurnee, IL (US); Joseph M. Ilk, Vernon Hills, IL (US); Santos Ares, Bolingbrook, IL (US); David M. Christopher, Homer Glen, IL (US)

(73) Assignee: Material Sciences Corporation, Engineered Materials and Solutions Group, Inc., Elk Grove Village, IL (US)

( * ) Notice: Subject to any disclaimer, the term of this patent is extended or adjusted under 35 U.S.C. 154(b) by 106 days.

(21) Appl. No.: 11/074,113

(22) Filed: Mar. 7, 2005

(51) Int. Cl.
*B32B 15/04* (2006.01)
*B32B 15/082* (2006.01)
*B32B 15/18* (2006.01)

(52) U.S. Cl. ..... 428/626; 428/659; 428/681; 428/213; 428/336; 428/219; 428/457; 428/461; 428/687

(58) Field of Classification Search ..... 428/626, 428/658, 659, 681, 687, 684, 685, 213, 334, 428/335, 336, 666, 219, 457, 461, 463, 469, 428/472, 542.2, 542.6, 543
See application file for complete search history.

(56) References Cited

U.S. PATENT DOCUMENTS

| | | | | |
|---|---|---|---|---|
| 4,374,902 | A | 2/1983 | Smith et al. | |
| 4,666,791 | A | 5/1987 | Lambert | |
| 4,707,415 | A | 11/1987 | Ikeda et al. | |
| 4,719,132 | A | 1/1988 | Porter, Jr. | |
| 4,789,566 | A | 12/1988 | Tatsuno et al. | |
| 4,820,555 | A | 4/1989 | Kuwajima et al. | |
| 4,882,228 | A | 11/1989 | Nakahama | |
| 5,879,532 | A | 3/1999 | Foster et al. | |
| 6,004,684 | A | 12/1999 | Sugg et al. | |
| 6,132,889 | A | 10/2000 | Welty et al. | |
| 6,231,932 | B1 | 5/2001 | Emch | |
| 6,413,642 | B1 | 7/2002 | Wegner et al. | |
| 6,440,582 | B1 * | 8/2002 | McDevitt et al. | 428/653 |
| 6,548,192 | B1 | 4/2003 | Chen | |
| 6,548,193 | B1 | 4/2003 | Chen | |
| 6,551,722 | B1 | 4/2003 | Jonte et al. | |
| 2001/0000482 | A1 * | 4/2001 | Sugimoto et al. | 428/461 |
| 2002/0114884 | A1 | 8/2002 | Friedersdorf et al. | |
| 2002/0146578 | A1 * | 10/2002 | Chen | 428/457 |
| 2002/0150784 | A1 | 10/2002 | Chen | |
| 2002/0150785 | A1 | 10/2002 | Chen | |
| 2003/0083000 | A1 | 5/2003 | Sambuco, Jr. et al. | |

FOREIGN PATENT DOCUMENTS

DE 100 22 541 A1 * 9/2001

* cited by examiner

*Primary Examiner*—Michael E. Lavilla
(74) *Attorney, Agent, or Firm*—Seyfarth Shaw LLP

(57) ABSTRACT

A coated metal article includes a ferrous metal substrate, and an abraded metallic coating on the substrate, wherein the abraded metallic coating has a substantially uniform patterned appearance which simulates the surface appearance of polished stainless steel. A top coating, which may be a relatively thick PVC coating or a thin coating of polyester, epoxy, or acrylic, may overlie the abraded metallic coating on an obverse side of the substrate. The metallic coating may be a Zinc-Nickel alloy and a pre-treatment coating may be applied beneath the top coating. A primer coating may be applied beneath the PVC top coating.

26 Claims, 4 Drawing Sheets
(2 of 4 Drawing Sheet(s) Filed in Color)

COATED METAL ARTICLE AND METHOD OF MAKING SAME

BACKGROUND

This application is directed to coated metal articles and methods of forming same and, in particular, to coated metal sheet material which may be suitable for, but not limited to, household appliance applications, as well as in architectural, industrial food service and/or electronic equipment enclosures.

Many household appliances, such as refrigerators, dishwashers, ranges and the like, are manufactured utilizing "polished" stainless steel sheet material, the surface of which is abraded by one or more belts. The polished stainless steel offers important rust and corrosion resistance characteristics, and additionally affords a unique surface appearance which has been found to be highly desirable. However, stainless steel is rather expensive and may have other significant disadvantages. For example, some stainless steels are non-magnetic, which may be disadvantageous in certain applications. Also, stainless steel may have poor resistance to fingerprints, stains and/or scratches. Stainless steel may be relatively difficult to clean, and typically requires specialized tooling different from that required for other steels in order to form/stamp parts for manufacturing. The specialized tooling is at times needed due to the mechanical properties of stainless steel vs. standard cold rolled steels.

It is known to utilize other steel materials, such as cold rolled steel, which are less expensive than stainless steel, and to use treatments, such as galvanizing, to afford adequate rust/corrosion resistance. However, heretofore, it has not been possible, utilizing metals other than stainless steel, to achieve the desirable surface appearance of polished stainless steel.

One attempt to simulate the desirable surface appearance of polished stainless steel is disclosed in U.S. Pat. No. 6,440,582, which utilizes an aluminum-zinc alloy-coated steel of the type sold under the trademark Galvalume®, wherein the alloy coating is brushed and includes a particulate compound. But that product does not afford corrosion resistance comparable to that of stainless steel and the hot dip process of applying the alloy coating results in a spangle, which the particulate compound is required to counteract. Also, the product, as disclosed, may not meet the visual and aesthetic requirements of most appliance manufacturers.

SUMMARY

There is disclosed herein an improved coated metal article and method of making same which avoids the disadvantages of prior articles and processes, while affording additional structural and operating advantages.

In particular, there is disclosed a coated metal article comprising a ferrous metal substrate, an abraded metallic coating on the substrate wherein the abraded metallic coating has a substantially uniform patterned appearance which simulates the surface appearance of polished stainless steel, and a polymer coating overlying the abraded metallic coating on one side of the substrate.

In an embodiment the polymer coating may be a relatively thick PVC coating.

In an embodiment, the article may include an abraded electrogalvanized steel substrate, including a pre-treatment coating and a primer coating underlying the polymer coating.

There is also disclosed a method of making a coated metal article which simulates the surface appearance of polished stainless steel, the method comprising providing a ferrous metal substrate, applying a metallic coating to the substrate to produce a metallic-coated substrate, abrading the metallic-coated substrate to produce an abraded metallic-coated substrate having a substantially uniform patterned appearance, and applying to one side of the abraded metallic-coated substrate at least a polymer coating.

There is also disclosed a method of applying by electrodeposition a galvanizing coating to a ferrous metal substrate to produce a galvanized substrate, and abrading the galvanized substrate to produce an abraded galvanized substrate having a substantially uniform patterned appearance, and applying a polymer coating to at least one side of the abraded galvanized substrate.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
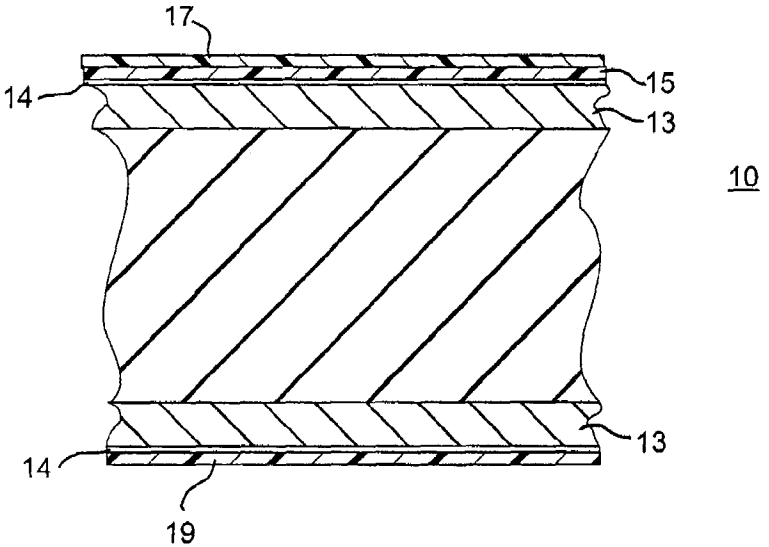
FIG. 1 is a diagrammatic illustration of a cross section through an embodiment of a coated metal article.

Referring to FIG. 1 there is diagrammatically illustrated a preferred embodiment of a coated metal article, generally designated by the numeral 10 (FIG. 1). The article may be in the form of an elongated, continuous strip, only a portion of which is illustrated, and the strip may have an overall thickness of only a fraction of an inch, depending upon the intended application. In this regard, it will be appreciated that FIG. 1, as well as FIGS. 3A–3E, 4 and 5, described below, are merely diagrammatic. In particular, FIGS. 1 and 3A–3E are greatly enlarged and the illustrated relative proportions of the various layers of the material are not intended to be accurate.

Figure 2:
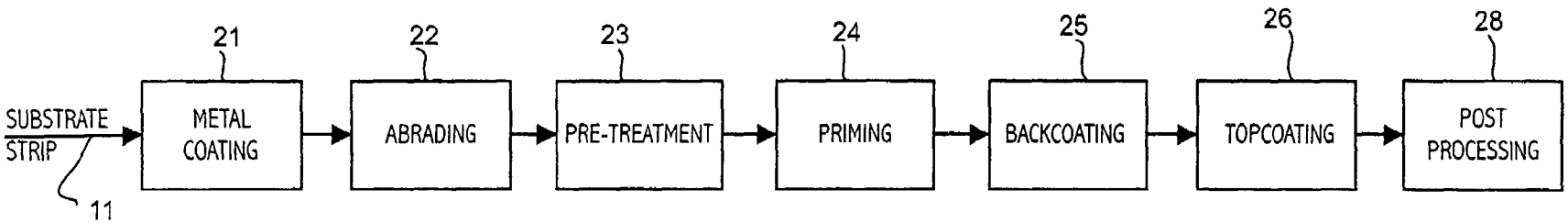
FIG. 2 is a functional block diagrammatic representation of a process of producing the article of FIG. 1.

The article 10 has a metal substrate 11 (FIG. 2), preferably a cold rolled steel (CRS) having a thickness in the range of from about 15 mils to about 80 mils, depending upon the intended application. The substrate is preferably free of any visual surface defects and has a matte finish with a roughness ($R_a$) which is preferably less than 30 micro-inches (μin), but may be as high as 60 μin. The thickness of the substrate 11 is limited only by the capability constraints of the processing line through which the strip is processed. Applicants have used processing lines which can handle base metal thicknesses from 6 mils to 100 mils. The tensile yield requirements of the substrate 11 are specific to the end use application, depending upon the forming processes required to produce an end product and the use requirements that the end product will see during its useful life.

Both sides of the substrate 111 are provided with a metallic coating 13, which is preferably a galvanizing coating which is predominantly Zinc, and is most preferably a Zinc alloy including about 11% Nickel. The outer surfaces of the metallic coatings 13 are abraded, as with polishing belts, to a predetermined substantially uniform patterned appearance having a low roughness finish, with a roughness ($R_a$) less than 20 μin, and preferably in the range of from about 5 μin to about 10 μin. The polished outer surfaces of the metallic coatings 13 have applied thereto a pre-treatment layer 14 which provides a clean surface for the chemical bonding of adjacent layers and to provide additional corrosion protection. To the pre-treatment layer 14, there is applied, on the obverse side of the article 10, a primer coating 15, which is preferably an acrylic based primer. Finally, on the obverse side of the article 10 (upper side as viewed in FIG. 1) there is applied to the primer coating 15 a polymeric top coating 17, which may be in the form of a PVC layer which may be tinted and is relatively thick so as more effectively to control the final color of the product and to also greatly enhance the corrosion and chemical resistance of the article 10. On the reverse side of the article 10, there is applied to the pre-treatment layer 14 a clear or tinted backer coating 19, which is preferably a polyester clear coat or other polymer as required to perform functionally or aesthetically, depending upon the end product.

Figure 3A:
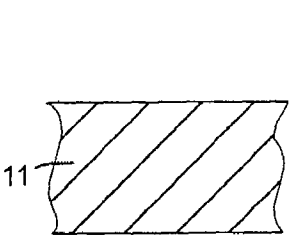
FIGS. 3A–3E are diagrammatic views similar to FIG. 1 illustrating the article at different stages of the process of FIG. 2.
Figure 3B:
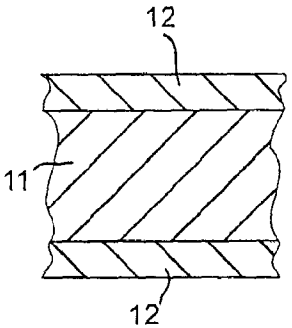

Referring now to FIGS. 2 and 3A–3E, there is illustrated a process for producing the coated metal article 10 of FIG. 1, as well as variants thereof. Initially, the substrate 111 undergoes a metal coating step at 21. The strip 11 may be fed from a continuous roll of material, the width of the strip being limited only by the capabilities of the processing line or lines through which it is to be fed. Applicants have used a line which will accommodate widths up to 72 inches. Preferably, in the metal coating step 21, the metallic coating is applied to the substrate 11 by electrodeposition. However, alternatively, a hot dip process could also be utilized, depending upon the nature of the coating material and the intended application of the product. In forming the coated metal article 10 of FIG. 1, the CRS substrate 11 (FIG. 3A) undergoes an electrogalvanizing step for applying the Zinc-Nickel alloy coating 12 to both sides of the substrate (FIG. 3B). In the electrogalvanizing line the substrate is cleaned and coated with the Zinc Nickel alloy to an applied weight of approximately 45 grams per square meter ($g/m^2$) per side of metal surface area. The Zinc in the galvanizing coating provides corrosion resistance in a known manner. The Nickel component of the coating gives slightly improved corrosion resistance as well as increased hardness to the metallic coating and has been found to produce an appearance which is desirable in more closely simulating the surface appearance of certain polished stainless steels. Upon completion of the metal coating step 21, the resulting product is an electrogalvanized substrate as illustrated in FIG. 3B.

Figure 4:
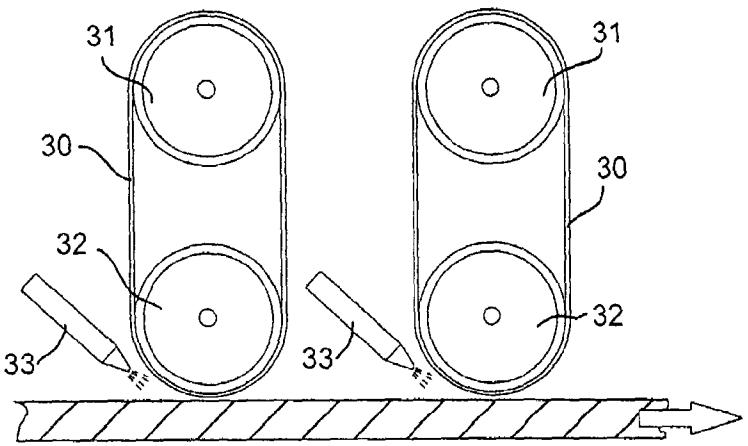
FIG. 4 is a diagrammatic illustration of one type of the apparatus utilized in the abrading step of the process of FIG. 2.

This electrogalvanized CRS substrate is then passed through an abrading step 22. Referring to FIG. 4, this abrading is preferably performed by one or more continuous polishing belts 30. The belts 30 may vary in number from one to several, depending upon the amount of material to be removed. While belts are illustrated in FIG. 4 on only the obverse side of the strip, it will be appreciated that they could also be used on the reverse side if the material is to be abraded on both sides. Since the abrading step is important in achieving the final appearance of the finished product, in many applications only the obverse side would be visible in use and, therefore, it may be necessary to provide abrading on only that surface. In FIG. 4 two of the belts are illustrated, each being entrained around upper and lower rollers 31 and 32, at least one of which is powered for rotation about its axis. Preferably, the areas of contact between the belts and the moving strip are flooded with a lubricant liquid, such as water, which may be applied through nozzles 33. This not only provides flushing of the surface to remove particulates, but also minimizes sticking or chatter between the belts and the moving strip of material.

Figure 3C:
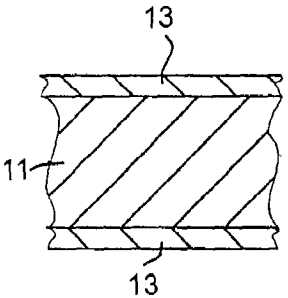
Figure 3D:
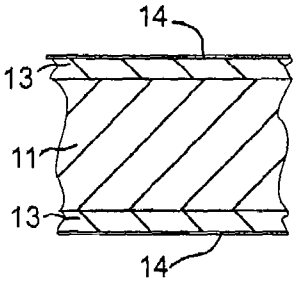
Figure 3E:
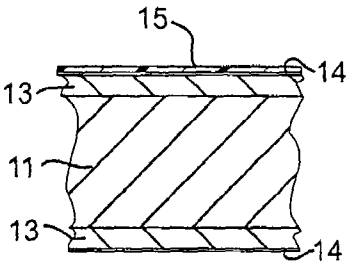
Figure 5:
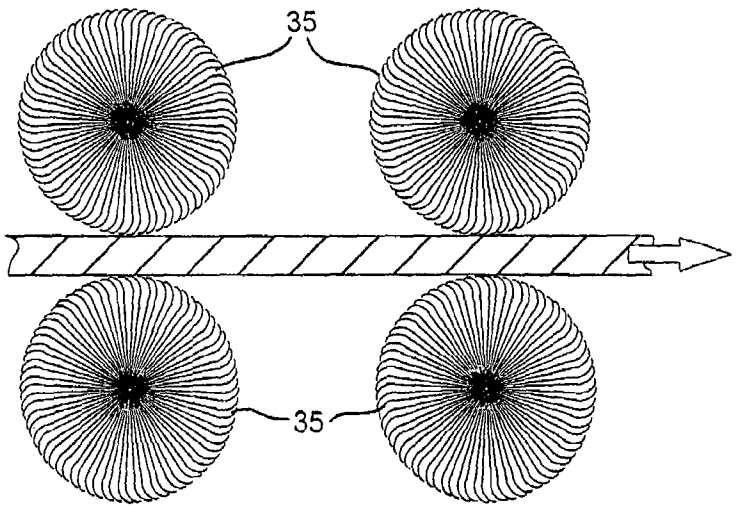
FIG. 5 is a view similar to FIG. 4 of an alternative type of apparatus for performing the abrading step of the process of FIG. 2.

The abrading or polishing, in addition to achieving a desired surface appearance, also tends to remove material from the metallic coating 12, resulting in the abraded metallic coating 13, as seen in FIG. 3C, which is thinned in comparison with the original metallic coating 12 (FIG. 3B). While initially the metallic coating 12 is applied at a minimum weight of 40 $g/m^2$ per side, typically in the range of 40–50 $g/m^2$, the polishing tends to remove approximately 20–30 $g/m^2$. In the preferred embodiment, the polished metallic coating 13 will have a weight of about 15 $g/m^2$ and preferably in the range of from about 15 to 25 $g/m^2$ of surface area. This will ensure that the polished coated substrate will maintain adequate corrosion protection. The polishing must also be effected to a degree to achieve a roughness ($R_a$) which is no greater than about 20 μin and preferably in the range of from about 5 to about 15 μin. The polishing may be varied to achieve these desired parameters by varying the number of belts, the belt pressure, the line speeds and the grit number of the belts. Also, the polishing parameters may be changed to give different visual appearances, as desired.

The foregoing parameters are those desired for applications in certain appliances such as refrigerator doors and refrigerator cabinets. However, there may be applications which have less demanding specifications, either because they do not require as accurate a simulation of the appearance of polished stainless steel or perhaps do not require the same level of corrosion protection. For such applications, it may be possible to perform the abrading step 22 utilizing brushes 35 (FIG. 5) similar to those used in forming polished stainless steel. The use of such brushes on either one or both sides of the substrate tends to result in a less uniform surface appearance, which may include some waviness, and a certain amount of chatter may occur between the brushes and the moving strip of substrate. The resulting roughness ($R_a$) is typically greater than 20 μin.

After the abrading step 22, the abraded metallic coated substrate of FIG. 3C undergoes a pre-treatment step 23 for applying, preferably, a complex oxide-based and/or chrome-containing pre-treatment, or non chrome alternative, which may be applied to one or both surfaces of the substrate via dip tank or coating rolls to prepare the surface of the abraded metallic coating 13 and make it more receptive to bonding of adjacent layers. This pre-treatment layer is designated 14 in FIG. 3D, and may be extremely thin. The pre-treatment may, depending on the type of treatment chosen and the amount applied, have the effect of changing the apparent color of the surface slightly.

Next, the pre-treated surfaces are primed in a priming step 24. The primer coating 15 is preferably an acrylic-based coating and is applied, by roll coating, to a dry film thickness in the range of from about 0.10 mil to about 0.4 mil, the resulting primed strip being shown at FIG. 3E.

The strip may also undergo a back coating step 25, in which there may be applied to the reverse surface of the strip a clear or tinted backer coating 19 (FIG. 1), such as a polyester coating, to complete the coated metal article 10. This coating may be applied to a thickness in the range of from about 0.10 to about 0.30 mils. It is typically not visible and tinting may or may not be used. An epoxy- or acrylic-based backer coating may be used in lieu of the polyester coating.

After priming, (and after the back coating step 25, if used) the primed strip undergoes a top coating step 26. In this step, there is applied to the obverse face of the primed strip a PVC coating 17 (FIG. 1), which is applied to a thickness in the range of from about 1.5 mils to about 2.5 mils. This is quite thick in comparison with general coating standards and permits more effective control of final color of the exposed surface. The PVC coating 17, which may include some tinting, such as blue, yellow, grey or other type of tinting, serves to provide enhanced corrosion resistance as well as refining the finished surface appearance of the strip to most closely simulate the surface appearance of the particular polished stainless steel being simulated.

If desired, the coated metal article 10 may undergo post processing, as at 28, which may include any of a number of different processing steps, such as supplying a protective strippable liner to the obverse surface of the strip, slitting of the strip, re-rolling of the strip, cutting into discrete sheets, and final shipment to a customer.

While, in the metal coating step 21, a Zinc Nickel alloy is preferably applied, as described above, it may be possible, for certain applications, to galvanize the substrate 11 utilizing a Zinc-only coating. The use of the Zinc Nickel coating is preferred, because it gives somewhat improved corrosion protection as well as increased hardness. However, because of the additional corrosion protection afforded by the PVC coating 17, the use of Nickel may not be necessary. This would improve economy, since a Zinc-only coating would be slightly less expensive. The Zinc-only galvanized material also has a slightly different appearance, and could be used in simulating the appearance of different stainless steels. For example, a Zinc-only coating could be used in simulating a 400-series stainless steel, while a Zinc Nickel coating could be used to simulate a 300-series stainless steel.

While electrodeposition of a Zinc Nickel coating is preferred, it may also be possible to use aluminized or hot dip galvanized substrates, depending upon the application. However, the aluminized coating has a different appearance from a Zinc galvanizing coating, which may be undesirable. The use of a hot dip process for applying a Zinc galvanizing coating may be somewhat less expensive than electrodeposition, but tends to result in a surface spangle, which must either be removed, or an operation must be performed to mask the spangle.

In the pre-treatment of step 23, the pre-treatment may be applied by a roll-on technique which has produced good corrosion and color results. It is also possible to use a dip tank treatment. It is further possible to pre-treat the strip with a chrome-containing treatment or, alternatively, in certain applications, a non-chrome containing treatment could be utilized.

In lieu of the priming and top coating steps 24 and 26 described above, there could be applied to the pre-treatment layer 14 on the obverse side of the strip a polymeric top coat in the form of a tinted polyester clear coat, which may be applied to a dry film thickness in the range of from about 0.15 mil to about 0.6 mil. While this thin polyester top coat may have a higher pencil hardness, which might be desirable in certain applications, it does not provide the same level of corrosion protection as the thick PVC coating and makes it more difficult to control color. Alternatively, the thin polymeric top coat could be an epoxy or acrylic coating.

The following examples illustrate different methods for creating different variations of different coated articles.

Example 1

A bare oiled Cold Rolled Steel (CRS) metal substrate strip was obtained with a gauge of approximately 0.0230 inch+ 0.003 allowable. Testing was performed to measure the roughness ($R_a$) values along the strip which measured at approximately 50 μin. The substrate strip was cleaned and electrogalvanized with a Zinc coating, with a target coating depth of 40 g/m$^2$ per side minimum. During the same pass through the coating line the electrogalvanized strip was abraded utilizing 1 or 2 12-inch×80-inch width roller covered with 5.75-inch of 3M Scotch Brite XF CB XDR clean and finish 5S fine material and the roll was driven at 1,130 rpm by 25 hp motors. Water spray nozzles were employed throughout the brushing operation. Some waviness and chatter occurred in the abraded pattern. The brushing resulted in a roughness finish in the range of from about 20 μin to about 40 μin. The Zinc coating was reduced in weight to between about 5 g/m2 and 20 g/m2 on the brushed surface. Later, during the same pass, the metal was pre-treated and coated on both sides utilizing a complex oxide-based pre-treatment followed by a polyester clear coat applied to the obverse side at a thickness of between 0.15 and 0.6 mils, without tinting, and a backer polyester coating applied at a thickness of 0.10–0.30 mils. The material was then inspected and a protective strippable liner was applied to the obverse side of the strip.

Figure 6:
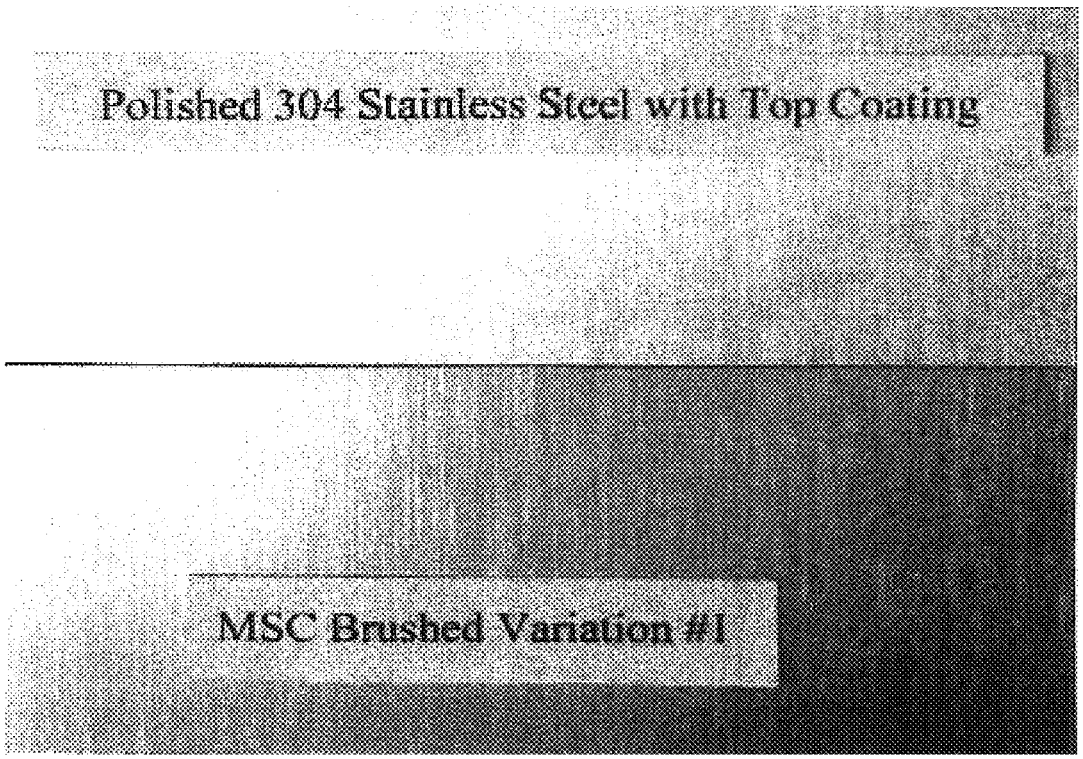
FIG. 6 is a photograph of the obverse sides of a first coated metal article made in accordance with the process of FIG. 2 and a prior-art polished stainless steel article.

FIG. 6 shows the obverse side of the finished coated metal article (bottom) side-by-side with a polished 304 stainless steel with top coating (top).

Example 2

The CRS metal strip was cleaned, as in Example 1, electrogalvanized with Zinc alloy coating composed of about 89% Zinc and 11% Nickel, and brushed as in Example 1. Then the brushed electrogalvanized strip was processed through a line and treated with a chrome-containing rolled on pre-treatment. Then a polyester coating was applied at a dry film thickness of about 0.15–0.60 mils to the obverse side of the strip and a polyester backer was applied to the reverse side of the strip at 0.10–0.30 mils dry film thickness. The material was then inspected and a protective strippable liner was applied to the obverse side of the strip.

Example 3

The CRS metal strip was cleaned, electrogalvanized with Zinc alloy coating composed of about 89% Zinc and 11% Nickel, as in Example 2. The galvanized strip was then polished utilizing a series of three continuous belt polishers with water lubrication. Then the polished electrogalvanized strip was processed through a continuous coil coating line and treated with a chrome-containing rolled on pretreatment. Then a polyester coating was applied at a dry film thickness of about 0.15–0.60 mils to the obverse side of the strip and a polyester backer was applied to the reverse side of the strip at 0.10–0.30 mils dry film thickness. The material was then inspected and a protective strippable liner was applied to the obverse side of the strip.

Example 4

A bare oiled CRS metal strip was obtained having $R_a$ roughness values in the range of between 33 and 38 μin, and having a gauge thickness 0.0230 inch minimum with +0.003 inch allowable. The strip was selected so as not to have visual defects or shape issues. The substrate metal strip was cleaned and electrogalvanized with a Zinc alloy bath, comprised of approximately 89% Zinc and 11% Nickel to a target coating of 40 g/m$^2$ per side minimum. Measurements taken across the width of the strip adjacent to first edge, center and second edge, respectively yielded thickness readings of 50.6 g/m$^2$, 46.7 g/m$^2$ and 49.9 g/m$^2$ per side. Surface roughness ($R_a$) was measured at 28 μin after electrogalvanizing. The galvanized strip was then polished utilizing a series of three continuous belt polishers with water lubrication. For this purpose the coil strip was split into three smaller coils so that measurements could more effectively be taken at different locations along the length of the original coil. Table 1 indicates the relative sizes of the three coil sections and Zinc-Nickel coating thickness and ($R_a$) after polishing at regions approximately 100 feet in from the start and end of each coil section. After polishing, the strip was processed through a continuous coating line and a Cr-containing pre-treatment was applied to both sides via a roll on treatment. Then an acrylic primer was applied to the obverse side at a dry film thickness of 0.1–0.4 mils. Thereafter, a polyester backer coating was applied to the reverse side at 0.10–0.30 mils dry film thickness and PVC top coat was applied with tinting to the obverse side at a 1.5–2.5 mils dry film thickness. Finally, a protective strippable liner was applied to the obverse side of the strip.

Figure 7:
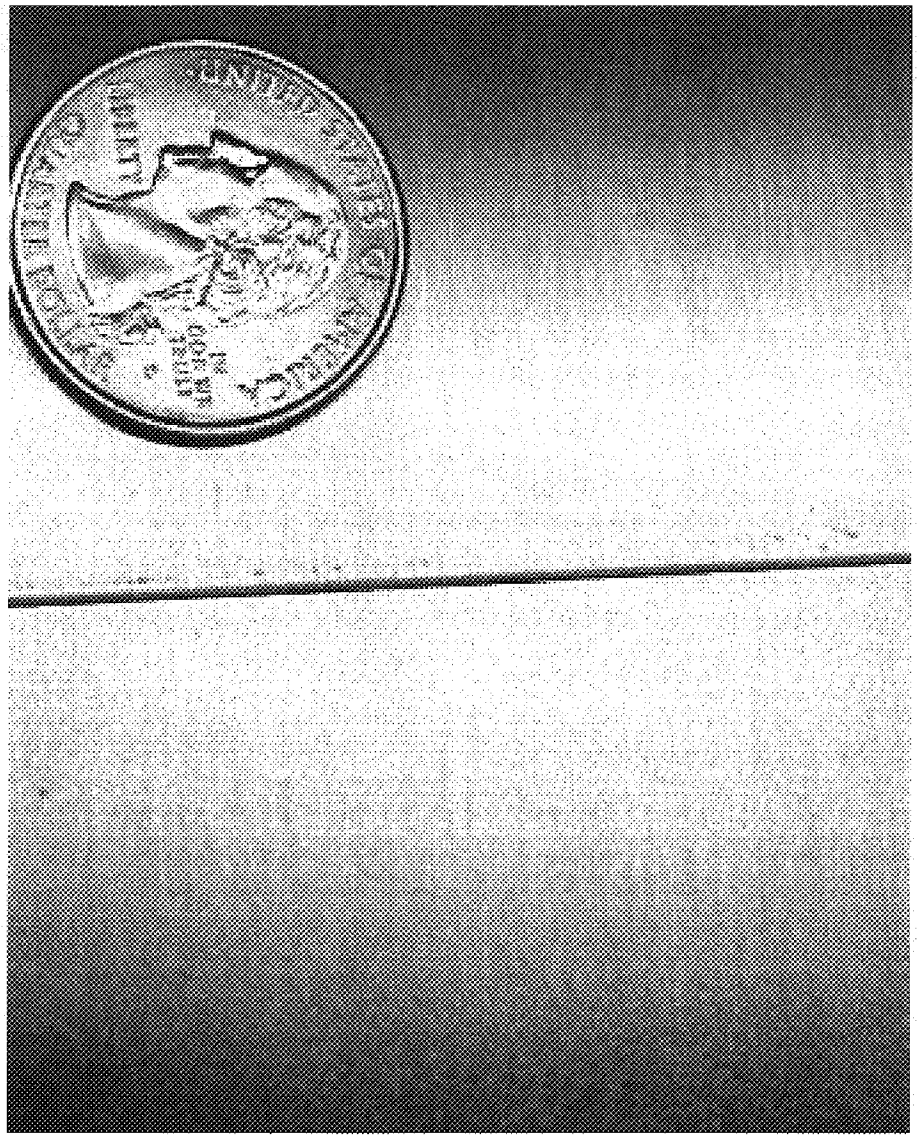
FIG. 7 is a photograph similar to FIG. 6 comparing the obverse sides of a second coated metal article made in accordance with the process of FIG. 2 and the stainless steel article.

FIG. 7 shows the obverse side of the finished coated metal strip (right) side-by-side with a polished stainless steel article with clear coat (left). A U.S. quarter coin is shown for scale.

TABLE 1

| Coil Number | Weight | Zn—Ni (North) after Polish | Zn—Ni (Center) after Polish | Zn—Ni (South) after Polish | $R_a$ |
|---|---|---|---|---|---|
| #1 Start | 14,750 lbs. | 10.0 g/m$^2$ | 14.5 g/m$^2$ | 21.7 g/m$^2$ | 6 |
| #1 End | | 23.5 g/m$^2$ | 16.2 g/m$^2$ | 24.6 g/m$^2$ | 5 |
| #2 Start | 14,890 lbs. | 16.0 g/m$^2$ | 13.5 g/m$^2$ | 22.7 g/m$^2$ | 6 |
| #2 End | | 31.5 g/m$^2$ | 25.5 g/m$^2$ | 30.0 g/m$^2$ | 5 |
| #3 Start | 13,520 lbs. | 24.9 g/m$^2$ | 22.2 g/m$^2$ | 27.8 g/m$^2$ | 8 |
| #3 End | | 30.0 g/m$^2$ | 26.0 g/m$^2$ | 34.0 g/m$^2$ | 6 |

The coated metal article of FIG. 1 as produced by the method of Example 4 closely simulates the surface appearance of polished stainless steel (SS), in particular a polished 300 Series stainless steel, while affording important advantages over the polished stainless steel product. More specifically, the coated article 10 has improved fingerprint resistance, is easier to clean than SS, displays magnetic properties, has easily adjustable color and gloss, is stain resistant, is less expensive, and does not require tooling changes. In addition, the coated article 10 is able to meet current applicable requirements for flexibility, adhesion, abrasion resistance, gloss, heat aging, impact resistance, alkali resistance, humidity exposure testing, salt spray exposure testing, stain resistance and UV resistance.

Example 5

A coated metal article was prepared in the same manner as in Example 4, except that in place of the rolled-on complex oxide-based pre-treatment, a Cr containing pre-treatment was applied to both sides via a dip treatment.

From the foregoing, it can be seen that there has been provided an improved coated metal article and method of making same which effectively simulates the surface appearance of polished stainless steel while affording important advantages over stainless steel.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A coated metal article comprising:

a ferrous metal substrate, an applied abraded metallic coating on the substrate wherein the abraded metallic coating has a substantially uniform patterned appearance which simulates the surface appearance of polished stainless steel, and a polymeric coating overlying the abraded metallic coating on an obverse side of the substrate, through which polymeric coating the substantially uniform patterned appearance is visible.

2. The article of claim 1, wherein the substrate is cold rolled steel.

3. The article of claim 1, wherein the metallic coating includes zinc.

4. The article of claim 3, wherein the metallic coating is a Zinc alloy.

5. The article of claim 4, wherein the alloy is a Zinc Nickel alloy.

6. The article of claim 5, wherein the alloy is about 11% Nickel.

7. The article of claim 1, wherein the substrate is a metal sheet.

8. The article of claim 7, wherein the substrate is in the form of a continuous strip.

9. The article of claim 8, wherein the substrate is less than 0.09 inch thick.

10. The article of claim 1, wherein the abraded metallic-coating has a roughness ($R_a$) less than 20 μin.

11. The article of claim 10, wherein the abraded metallic-coating has a roughness ($R_a$) in the range of from about 5 to about 15 μin.

12. The article of claim 1, wherein the polymeric coating is PVC and has a thickness in the range of from about 1.5 mils to about 2.5 mils.

13. The article of claim 12, wherein the article further comprises a primer layer between the PVC coating and the abraded metallic coating.

14. The article of claim 13, wherein the primer layer is an acrylic-based coating.

15. The article of claim 13, wherein the primer layer has a thickness in the range of from about 0.10 mil to about 0.4 mil.

16. The article of claim 1, wherein the polymeric coating is a polyester, epoxy or acrylic coating and has a thickness in the range of from about 0.15 mil to about 0.6 mil.

17. The article of claim 1, wherein the article further comprises a pretreatment layer disposed on the abraded metallic coating.

18. The article of claim 17, wherein the pretreatment layer is a complex oxide-based layer or Cr-containing coating.

19. The article of claim 1, wherein the abraded metallic coating has an applied weight greater than or equal to 15 $g/m^2$ of surface area.

20. The article of claim 1, wherein the abraded metallic coating has an applied weight in the range of from about 10 to about 30 $g/m^2$ of surface area.

21. The article of claim 1, wherein the article further comprises a clear backer coating on a reverse side of the substrate.

22. A coated metal article comprising:

an abraded electrogalvanized steel substrate having a substantially uniform patterned appearance which simulates the surface appearance of polished stainless steel, a pre-treatment coating on an obverse surface of the abraded electrogalvanized substrate, a primer coating on the pre-treatment coating, and a PVC coating on the primer coating.

23. The article of claim 22, wherein the abraded electrogalvanized steel substrate has a roughness ($R_a$) in the range of from about 5 to about 15 μin.

24. The article of claim 22, wherein the pre-treatment coating is a complex oxide-based layer or Cr-containing coating.

25. The article of claim 24, wherein the primer coating has a thickness in the range of from about 0.10 to about 0.4 mil.

26. The article of claim 21, wherein the PVC coating has a thickness in the range of from about 1.5 mils to about 2.5 mils.

* * * * *